US007766513B2

(12) United States Patent
Zhang et al.

(10) Patent No.: US 7,766,513 B2
(45) Date of Patent: Aug. 3, 2010

(54) LED LAMP WITH A HEAT DISSIPATION DEVICE

(75) Inventors: Wen-Xiang Zhang, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 245 days.

(21) Appl. No.: 12/019,901

(22) Filed: Jan. 25, 2008

(65) Prior Publication Data

US 2009/0129103 A1 May 21, 2009

(30) Foreign Application Priority Data

Nov. 16, 2007 (CN) ..... 2007 1 0124551

(51) Int. Cl.
*F21V 29/00* (2006.01)

(52) U.S. Cl. ..... 362/294; 362/249.02; 362/373

(58) Field of Classification Search ..... 362/218, 362/249.02, 294, 373

See application file for complete search history.

(56) References Cited

U.S. PATENT DOCUMENTS

| | | | | |
|---|---|---|---|---|
| 4,012,770 | A * | 3/1977 | Pravda et al. | 257/715 |
| 7,329,030 | B1 * | 2/2008 | Wang | 362/373 |
| 7,682,055 | B2 * | 3/2010 | Shuai et al. | 362/373 |
| 7,695,161 | B2 * | 4/2010 | Zhang et al. | 362/294 |
| 2008/0130299 | A1 * | 6/2008 | Dorogi | 362/373 |
| 2009/0095959 | A1 * | 4/2009 | Lai et al. | 257/79 |
| 2009/0129075 | A1 * | 5/2009 | Shuai et al. | 362/234 |

* cited by examiner

*Primary Examiner*—Stephen F Husar
*Assistant Examiner*—James W Cranson
(74) *Attorney, Agent, or Firm*—Jeffrey T. Knapp

(57) ABSTRACT

An LED lamp includes a heat sink, a triangular-shaped ridge positioned on the heat sink and an LED module mounted on the ridge. The heat sink includes a base and a plurality of first and second fins respectively extending from a first and a second surface of the base, with a plurality of channels defined between the first and second fins. The ridge is positioned on the second surface of the base. The ridge has a lateral surface which has a height decreasing from a middle to a lateral side of the ridge and decreasing from a rear end to a front end of the ridge. The LED module is mounted on the lateral surface of the ridge.

16 Claims, 5 Drawing Sheets

LED LAMP WITH A HEAT DISSIPATION DEVICE

BACKGROUND OF THE INVENTION

1. Field of the Invention

The present invention relates to a light emitting diode (LED) lamp, and more particularly to an LED lamp incorporating a heat dissipation device for improving heat dissipation of the LED lamp.

2. Description of Related Art

An LED lamp is a type of solid-state lighting that utilizes light-emitting diodes (LEDs) as a source of illumination. An LED is a device for transferring electricity to light by using a theory that, if a current is made to flow in a forward direction through a junction comprising two different semiconductors, electrons and cavities are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

LED modules for use in an LED lamp require many LEDs, and most of the LEDs are driven at the same time, which results in a quick rise in temperature of the LED modules. Therefore, a heat dissipation device is needed to dissipate heat generated by the LED modules of the LED lamp. A related heat dissipation device attached to the LED modules usually comprises a heat sink having a base and a plurality of fins mounted on one side of the base. The LED modules are mounted on another side of the base opposite to the fins. The fins are located parallel to each other and perpendicular to the base. A plurality of channels are defined between the fins of the heat sink and arranged parallel to each other. A cooling airflow passes through the channels defined by the fins of the heat sink, whereby heat generated by the LED modules can be absorbed by the fins and then dissipated to atmosphere. Accordingly, the LED lamp can be cooled to some degree.

However, as a power of the LED modules for use in the LED lamp continues to advance, an amount of heat generated by the LED modules becomes more and more huge. Operation of the conventional LED modules has a problem of instability because of insufficient heat dissipating efficiency of the heat dissipation device. Consequently, the light from the LED lamp often flickers, which degrades the quality of the illumination.

Besides, since the LED modules are generally arranged on a heat dissipation device which has a flattened surface, an illumination area of the LED lamp is restricted by the arranged position of the LED modules, whereby a larger illumination area can not be provided.

What is needed, therefore, is an LED lamp with a heat dissipation device, which has a great heat dissipating capability. Furthermore, the heat dissipation device has a unique design, whereby the LED lamp can provide a larger illumination area.

SUMMARY OF THE INVENTION

An LED lamp includes a heat sink, a triangular-shaped ridge positioned on the heat sink and an LED module mounted on the ridge. The ridge has a lateral surface which has a height decreasing from a middle to a lateral side of the ridge and decreasing from a rear end to a front end of the ridge. The LED module is mounted on the lateral surface of the ridge. The heat sink includes a base and a plurality of first and second fins respectively extending from a first and a second surface of the base, with a plurality of channels defined between the first and second fins. The ridge is positioned on the second surface of the base, and the second fins are located at two lateral sides of the ridge.

Other advantages and novel features will become more apparent from the following detailed description of preferred embodiments when taken in conjunction with the accompanying drawings, in which:

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
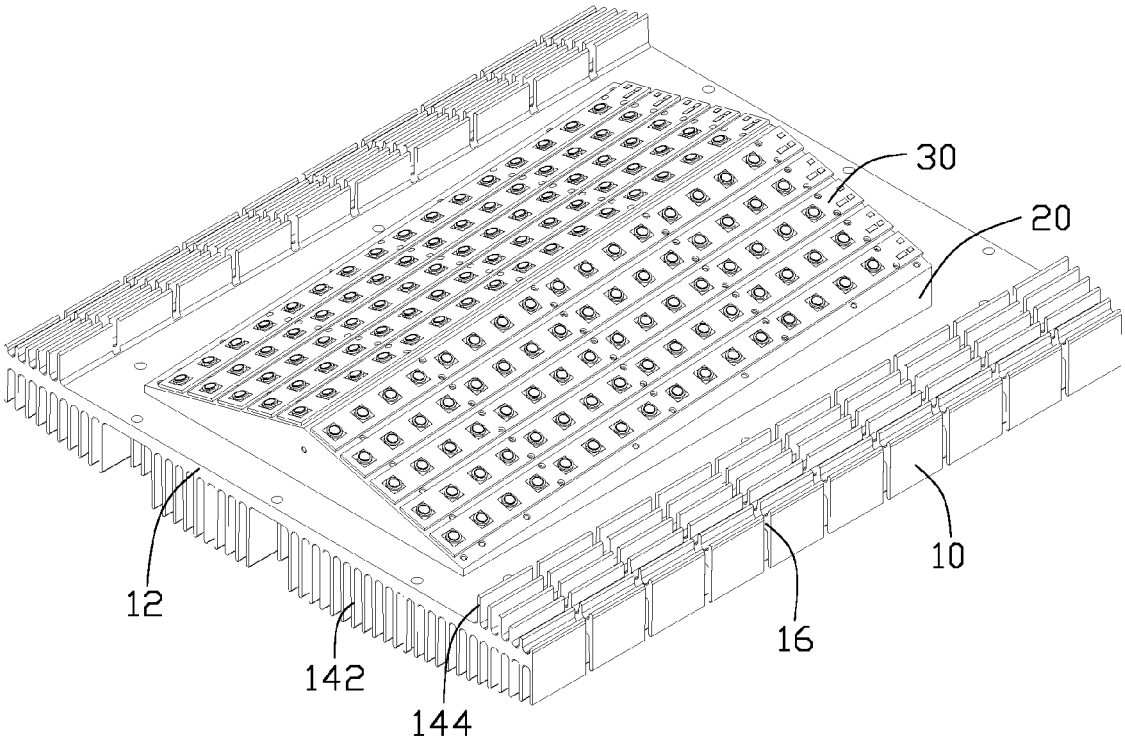
FIG. 1 is an isometric, assembled view of an LED lamp with a heat dissipation device in accordance with a preferred embodiment of the present invention.
Figure 2:
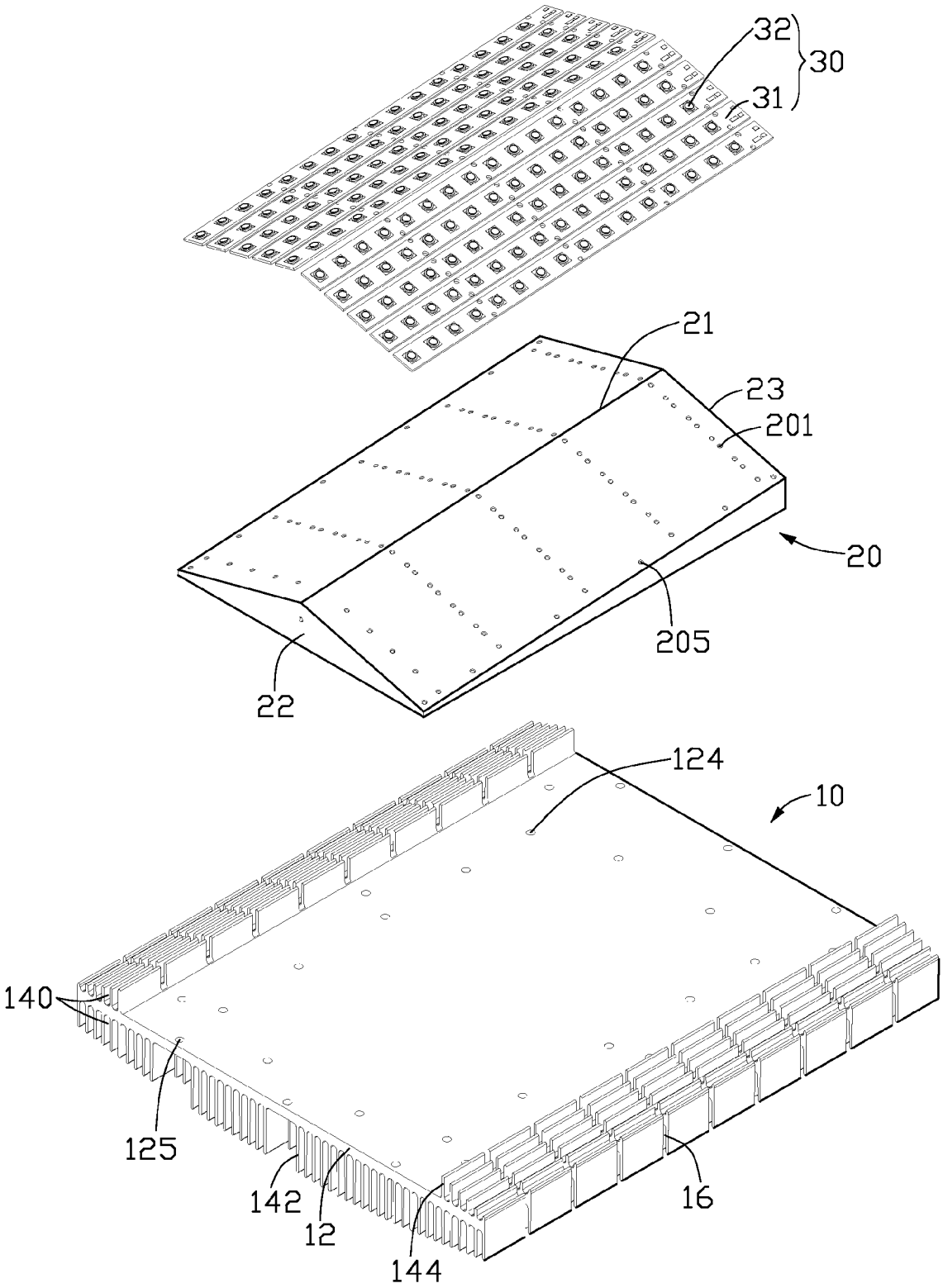
FIG. 2 is an exploded view of FIG. 1.
Figure 3:
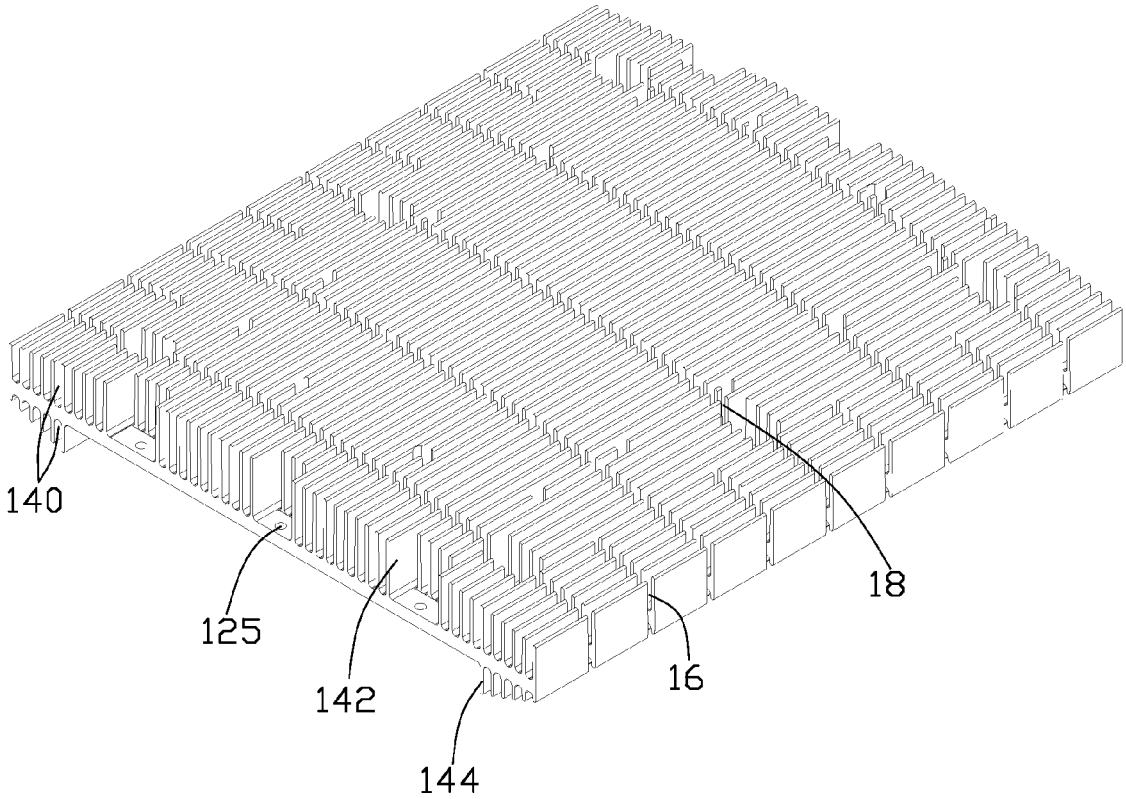
FIG. 3 is an assembled view of FIG. 1, viewed from another aspect.

Referring to FIGS. 1-3, an LED lamp with a heat dissipation device in accordance with a preferred embodiment is illustrated. The LED lamp comprises a heat sink 10, a triangular-shaped ridge 20 positioned on the heat sink 10 and an LED module 30 attached to the ridge 20. The heat sink 10 and the ridge 20 are used to cool down the LED module 30 to keep the LED module 30 working within an acceptable temperature range.

The heat sink 10 comprises a base 12, a plurality of first fins 142 extending from a bottom surface of the base 12 and a plurality of second fins 144 extending from a top surface of the base 12. The base 12 has a substantially rectangular shape. A plurality of first through holes 124 corresponding to side edges of the ridge 20 are defined in the base 12 for fixtures (not shown) to extend therethrough to secure the ridge 20 on the base 12. A plurality of second through holes 125 are defined around the first through holes 124 for fixtures (not shown) to extend therethrough to secure the heat dissipation device to a stand (not shown) of the LED lamp. The first fins 142 extend downwardly from the bottom surface of the base 12 and perpendicular to the base 12. The first fins 142 extend along a longitudinal direction and parallel to each other. Heights of the first fins 142 are gradually decreased along a direction away from a middle portion of the base 12 in such a manner that a bottom of the first fins 142 has an arced configuration (clearly seen from FIG. 4). The second fins 144 extend upwardly from two lateral side edges of the top surface of the base 12 and perpendicular to the base 12. The second fins 144 extend along a longitudinal direction and parallel to each other. Heights of the second fins 144 are gradually decreased along a direction away from the ridge 20. A plurality of longitudinal channels 140 are defined between every two adjacent first fins 142 and every two adjacent second fins 144. The channels 140 are parallel to two opposite long sides of the base 12. A plurality of transverse slits 16 are recessed from the two opposite long sides of the base 12, crossing the first fins 142 near the two opposite long sides of the base 12 and the second fins 144 to interrupt continuities of the two opposite long sides of the base 12, the first fins 142 located near the two opposite long sides of the base 12 and the second fins 144. The slits 16 are arranged at intervals and along a direction parallel to two short sides of the base 12 of the heat sink 10, i.e., perpendicular to the channels 140. The outer first fins 142 located near the two long sides of the base 12 and the second fins 144 are divided into a plurality of small parts separated from each other to define a plurality of airflow passages. A plurality of grooves 18 transversely extend through the first fins 142 of the heat sink 10 and spaced with each other at a predetermined interval which is double of that between two adjacent slits 16 along a longitudinal direction of the base 12. Each groove 18 is defined to directly communicate with a corresponding slit 16 so that the grooves 18 and the corresponding slits 16 extend continuously through the first fins 142 along a direction perpendicular to the channels 140 between the first fins 142 of the heat sink 10, whereby the channels 140 are divided into a plurality of parts via the slits 16 and the grooves 18.

The ridge 20 is arranged on the top surface of the base 12. The ridge 20 is made of metal such as aluminum, copper or an alloy of the two. The ridge 20 extends along a direction parallel to the long sides of the base 12. A top end 21 of the ridge 20 is parallel to the second fins 144 and positioned at a middle portion of the top surface of the base 12. A height of the ridge 20 is gradually decreased along a direction from the top end 21 towards two lateral sides of the ridge 20, whereby an acute angle is defined between each of the two lateral surfaces of the ridge 20 and the top surface of the base 12. The ridge 20 is symmetric relative to the top end 21 thereof. Furthermore, a height of the ridge 20 is gradually decreased from a rear end 23 of the ridge 20 towards a front end 22 of the ridge 20, whereby an acute angle is defined between the top end 21 of the ridge 20 and the top surface of the base 12. The two lateral surfaces of the ridge 20 are flattened for mounting the LED module 30 thereon, and define a plurality of holes 201 therein for fixtures (not shown) to extend therethrough to secure the LED module 30 on the ridge 20. Corresponding to the first through holes 124 on the base 12, a plurality of third through holes 205 are defined in side edges of the ridge 20 for fixtures to extend therethrough to secure the ridge 20 on the heat sink 10. The second fins 144 are located at two lateral sides of the ridge 20. In this embodiment, the ridge 20 is a metal block, and arranged on the heat sink 10. Alternatively, the ridge 20 can be a vapor chamber. Furthermore, the ridge 20 can extend integrally from the top surface of the base 12 to reduce a heat conducting resistance therebetween.

The LED module 30 comprises a plurality of printed circuit boards 31 and a plurality of LEDs 32 arrayed on the printed circuit boards 31. The printed circuit boards 31 have an elongated bar-shaped and mounted side by side on the two lateral surfaces of the ridge 20. Understandably, the printed circuit boards 31 can be replaced by a larger single printed circuit board, whereby the LEDs 32 can be bonded thereon in matrix.

In assembly, the ridge 20 is arranged on the top surface of the base 12 of the heat sink 10. The printed circuit boards 31 of the LED module 30 are mounted on the two lateral surfaces of the ridge 20 and thermally connect therewith.

Figure 4:
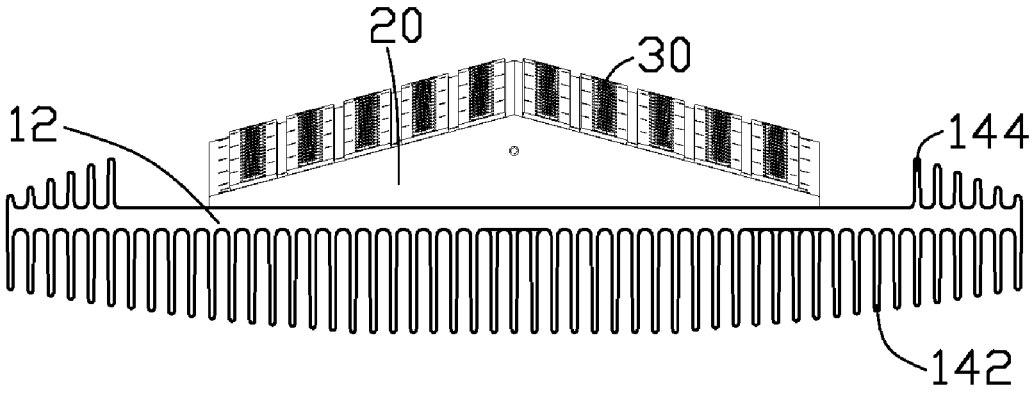
FIG. 4 is a front view of FIG. 1.
Figure 5:
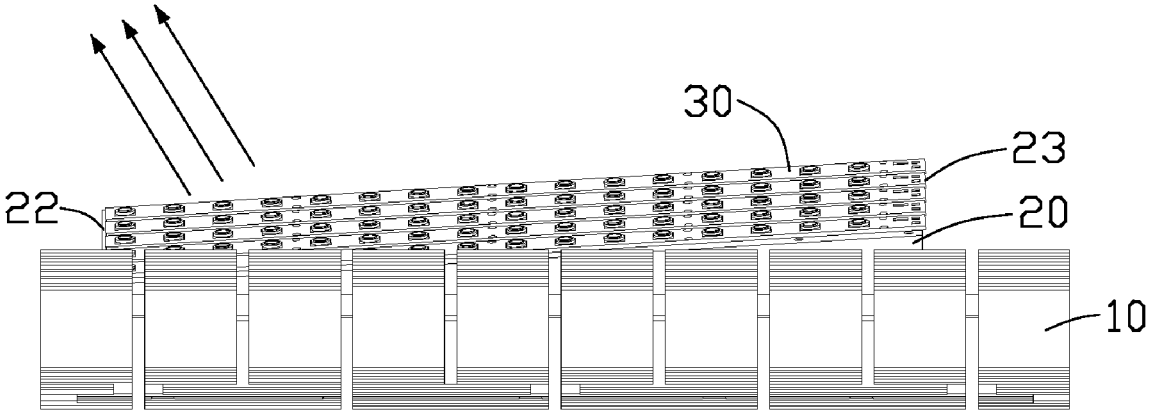
FIG. 5 is a side view of FIG. 1.

In operation, referring to FIGS. 4-5, the ridge 20 can absorb the heat generated by the LED module 30 and quickly transfer the heat to the base 12. The base 12 of the heat sink 10 then directly transfers the heat to the first and second fins 142, 144 to be dissipated to ambient air. A cooling airflow can flow into the channels 140 defined between the first and second fins 142, 144. A part of the cooling airflow flows along the channels 140 and is heated when contacting with the first and second fins 142, 144; then, the heated cooling airflow flows away from the two short sides of the base 12 of the heat sink 10. By the provision of the grooves 18 and slits 16 defined in the first fins 142 and second fins 144 of the heat sink 10 and perpendicular to the channels 140 to interrupt a continuity of the channels 140, another part of the cooling airflow can flow along the grooves 18 and slits 16, and then flow away from the two long sides of the base 12 of the heat sink 10. The cooling airflow is discharged from the first and second fins 142, 144 of the heat sink 10 not only along the channels 140 from the short sides of the base 12 of the heat sink 10 but also along the grooves 18 and slits 16 from the long sides of the base 12 of the heat sink 10. The cooling airflow flows away from the first and second fins 142, 144 of the heat sink 10 along the four sides of the base 12 of the heat sink 10 so that the cooling airflow has more airflow paths away from the heat sink 10, in comparison with a conventional heat sink having fins only defining channels therebetween, without slits and grooves intercrossing the channels. Therefore, the cooling airflow can have a more sufficient contact with the first and second fins 142, 144, and the heat dissipation efficiency of the heat sink 10 is greatly enhanced.

As the printed circuit boards 31 on the two lateral surfaces of the ridge 20 are slantwise to the top surface of the base 12, the light emitted by the LEDs 32 on the printed circuit boards 31 can project outwardly towards two lateral sides of the heat sink 10. Therefore, an irradiation area of the LED lamp in accordance with the present invention can spread outwardly towards two lateral sides of the heat sink 10 and is accordingly enlarged. Besides, since the height of the ridge 20 is increased from the front end 22 thereof towards the rear end 23 thereof, the LED module 30 is titled along a front-to-rear direction, in addition to the lateral direction, whereby the illumination area of the LED lamp in accordance with the present invention can be further enlarged.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp, comprising:

a heat sink comprising:

a base having a first surface and a second surface opposite to the first surface thereof; and a plurality of first and second fins extending from the first and second surface of the base, respectively, with a plurality of channels defined between the first and second fins;

a triangular-shaped ridge positioned on the second surface of the base, wherein the ridge has two lateral surfaces each titled in both a lateral direction and a front-to-rear direction; and an LED module directly mounted on the lateral faces of the ridge.

2. The LED lamp as claimed in claim 1, wherein a height of the ridge is gradually decreased from a top end of the ridge towards two lateral sides of the ridge, and the ridge is symmetric relative to the top end thereof.

3. The LED lamp as claimed in claim 1, wherein a height of the ridge is gradually decreased from a rear end of the ridge towards a front end of the ridge.

4. The LED lamp as claimed in claim 1, wherein the ridge extends integrally from the second surface of the base.

5. The LED lamp as claimed in claim 1, wherein the ridge is a vapor chamber.

6. The LED lamp as claimed in claim 1, wherein the second fins are located at two lateral sides of the ridge, and heights of the second fins located at each of lateral sides of the ridge are gradually decreased along a direction away from the each of lateral sides of the ridge.

7. The LED lamp as claimed in claim 1, wherein heights of the first fins are gradually decreased along a direction away from a middle portion of the base of the heat sink.

8. The LED lamp as claimed in claim 1, wherein the LED module comprises a plurality of printed circuit boards mounted on the ridge, and each of the plurality of printed circuit boards has a plurality of LEDs arrayed thereon.

9. The LED lamp as claimed in claim 1, wherein a plurality of slits is defined through two opposite side edges of the base and the first and second fins of the heat sink, and the slits are perpendicular to the channels.

10. The LED lamp as claimed in claim 9, wherein a plurality of grooves cuts through the first fins, and at least one of the grooves communicates with one of the slits.

11. A heat dissipation device for dissipating heat from LED modules, comprising:

a heat sink comprising a base having a plurality of first fins on one side thereof; and a triangular ridge positioned at an opposite side of the base, adapted for mounting the LED modules thereon, wherein a height of the ridge is gradually decreased from a top end thereof towards two lateral sides thereof, and a height of the ridge is also gradually decreased from one end thereof to another end thereof.

12. The heat dissipation device as claimed in claim 11, wherein the top end of the ridge is at a middle portion of the opposite side of the base, and the ridge is symmetric respect to the top end thereof.

13. The heat dissipation device as claimed in claim 11, wherein the ridge is a vapor chamber.

14. The heat dissipation device as claimed in claim 11, wherein a plurality of slits are defined through two opposite side edges of the base and the first fins at the two opposite side edges of the base.

15. The heat dissipation device as claimed in claim 14, wherein a plurality of grooves cuts through the first fins and at least one of the grooves communicates with one of the slits.

16. The heat dissipation device as claimed in claim 11, wherein the heat sink further comprises a plurality of second fins on the opposite side of the base, and the second fins are located at two lateral sides of the ridge.

* * * * *